US010329107B2

(12) United States Patent
Yamamoto

(10) Patent No.: US 10,329,107 B2
(45) Date of Patent: Jun. 25, 2019

(54) CONVEYING APPARATUS

(71) Applicant: BROTHER KOGYO KABUSHIKI KAISHA, Nagoya-shi, Aichi-ken (JP)

(72) Inventor: Ryuji Yamamoto, Handa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/939,534

(22) Filed: Mar. 29, 2018

(65) Prior Publication Data

US 2018/0282091 A1 Oct. 4, 2018

(30) Foreign Application Priority Data

Mar. 30, 2017 (JP) ..... 2017-068749

(51) Int. Cl.
*B65H 5/06* (2006.01)
*B65H 5/38* (2006.01)
(Continued)

(52) U.S. Cl.
CPC ..... *B65H 5/062* (2013.01); *B65H 1/266* (2013.01); *B65H 3/06* (2013.01); *B65H 3/0684* (2013.01); *B65H 3/66* (2013.01); *B65H 5/38* (2013.01); *B65H 29/125* (2013.01); *B65H 2402/10* (2013.01); *B65H 2402/52* (2013.01); *B65H 2404/133* (2013.01); *B65H 2404/17* (2013.01); *B65H 2404/52132* (2013.01); *B65H 2404/611* (2013.01); *B65H 2405/1136* (2013.01); *B65H 2405/325* (2013.01); *B65H 2405/332* (2013.01); *B65H 2553/81* (2013.01)

(58) Field of Classification Search
CPC . B65H 5/062; B65H 5/06; B65H 5/38; B65H 5/36; B65H 2402/52; B65H 2402/521; B65H 2402/522; B65H 2402/5221; B65H 2404/17; B65H 2404/611; B65H 2404/6111; B65H 29/12; B65H 29/125; B65H 29/14
See application file for complete search history.

(56) References Cited

U.S. PATENT DOCUMENTS 4,729,557 A * 3/1988 Kiyohara ..... B41J 11/02 271/264
8,322,715 B2 * 12/2012 Mandel ..... B65H 5/062 271/264

(Continued)

FOREIGN PATENT DOCUMENTS

JP 2008-239281 A 10/2008

*Primary Examiner* — Luis A Gonzalez
(74) *Attorney, Agent, or Firm* — Merchant & Gould P.C.

(57) ABSTRACT

A conveying apparatus includes: a rotation shaft; a conveying roller secured to the rotation shaft; a driven roller that cooperates with the conveying roller to convey a sheet at a nip position; a supporter supporting the rotation shaft rotatably; and a first guide and a second guide opposed to each other and defining a conveyance path guiding the sheet toward the nip position. The first guide and the second guide respectively have first and second guide surfaces defining the conveyance path. The first guide and the second guide respectively have first and second engaging portions engaged with the rotation shaft at positions different from a position of the supporter in the axial direction of the rotation shaft.

15 Claims, 8 Drawing Sheets

(51) Int. Cl.

| | |
|---|---|
| ***B65H 29/12*** | (2006.01) |
| ***B65H 3/06*** | (2006.01) |
| ***B65H 1/26*** | (2006.01) |
| ***B65H 3/66*** | (2006.01) |

(56) References Cited

U.S. PATENT DOCUMENTS

| | | | | |
|---|---|---|---|---|
| 9,790,042 | B2 * | 10/2017 | Iwasawa | B65H 5/062 |
| 2007/0000966 | A1 * | 1/2007 | Tsusaka | B41J 13/03<br>226/101 |
| 2007/0065201 | A1 * | 3/2007 | Fujiwara | G03G 15/6529<br>399/405 |
| 2008/0036141 | A1 * | 2/2008 | Liu | B65H 5/025<br>271/274 |
| 2008/0239046 | A1 | 10/2008 | Shiohara | |

* cited by examiner

CONVEYING APPARATUS

CROSS REFERENCE TO RELATED APPLICATION

The present application claims priority from Japanese Patent Application No. 2017-068749, which was filed on Mar. 30, 2017, the disclosure of which is herein incorporated by reference in its entirety.

BACKGROUND

The following disclosure relates to a conveying apparatus configured to convey a sheet.

There is conventionally known a conveying apparatus including an outer guide member and an inner guide member which guide a sheet to a conveying roller pair. The conveying roller pair is constituted by a conveying roller and a pinch roller which is brought into pressing contact with the conveying roller. In this conveying apparatus, hooks provided on the outer guide member respectively hold bearings fitted on opposite end portions of the conveying roller. The outer guide member is engaged with and positioned to the frame. The inner guide member is assembled and secured to the frame.

SUMMARY

In the above-described conveying apparatus, the outer guide member is positioned to a rotation shaft of the conveying roller and the frame, but the inner guide member is positioned only to the frame. That is, the inner guide member is not positioned to the rotation shaft of the conveying roller. Thus, there is a possibility that the sheet to be conveyed to a nip position at which the conveying roller and the pinch roller nip the sheet is not guided appropriately. This may result in an occurrence of a sheet jam because the sheet conveyed toward the nip position cannot pass through the nip position by contacting the conveying roller or the pinch roller, for example.

Accordingly, an aspect of the disclosure relates to a conveying apparatus capable of appropriately guiding a sheet to a nip position at which a conveying roller and a driven roller nip the sheet.

One aspect of the disclosure relates to a conveying apparatus, comprising: a rotation shaft configured to be driven to rotate; a conveying roller secured to the rotation shaft; a driven roller opposed to the conveying roller and configured to cooperate with the conveying roller to nip a sheet at a nip position to convey the sheet; a supporter supporting the rotation shaft such that the rotation shaft is rotatable; and a first guide and a second guide defining a conveyance path that guides the sheet from an upstream side of the nip position in a conveying direction toward the nip position, the first guide and the second guide being opposed to each other in an opposed direction orthogonal to each of the conveying direction and an axial direction of the rotation shaft, wherein the first guide comprises: a first guide surface defining the conveyance path; and a first engaging portion engaged with the rotation shaft at a position different from a position of the supporter in the axial direction of the rotation shaft, and wherein the second guide comprises: a second guide surface defining the conveyance path; and a second engaging portion engaged with the rotation shaft at a position different from the position of the supporter and a position of the first engaging portion in the axial direction of the rotation shaft.

Another aspect of the disclosure relates to a conveying apparatus, comprising: a rotation shaft configured to be driven to rotate; a conveying roller secured to the rotation shaft; a driven roller opposed to the conveying roller and configured to cooperate with the conveying roller to nip a sheet at a nip position to convey the sheet; a bearing supporting the rotation shaft such that the rotation shaft is rotatable; a supporter on which the bearing is mounted; and a first guide and a second guide defining a conveyance path that guides the sheet from an upstream side of the nip position in a conveying direction toward the nip position, the first guide and the second guide being opposed to each other in an opposed direction orthogonal to each of the conveying direction and an axial direction of the rotation shaft, wherein the first guide is supported by the supporter and comprises a first recess having a U-shape in cross section and opening upward, wherein the second guide is supported by the supporter and comprises a second recess having a U-shape in cross section and opening upward, and wherein the rotation shaft is supported by the bearing in a state in which the rotation shaft is inserted in the first recess and the second recess.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Figure 1:
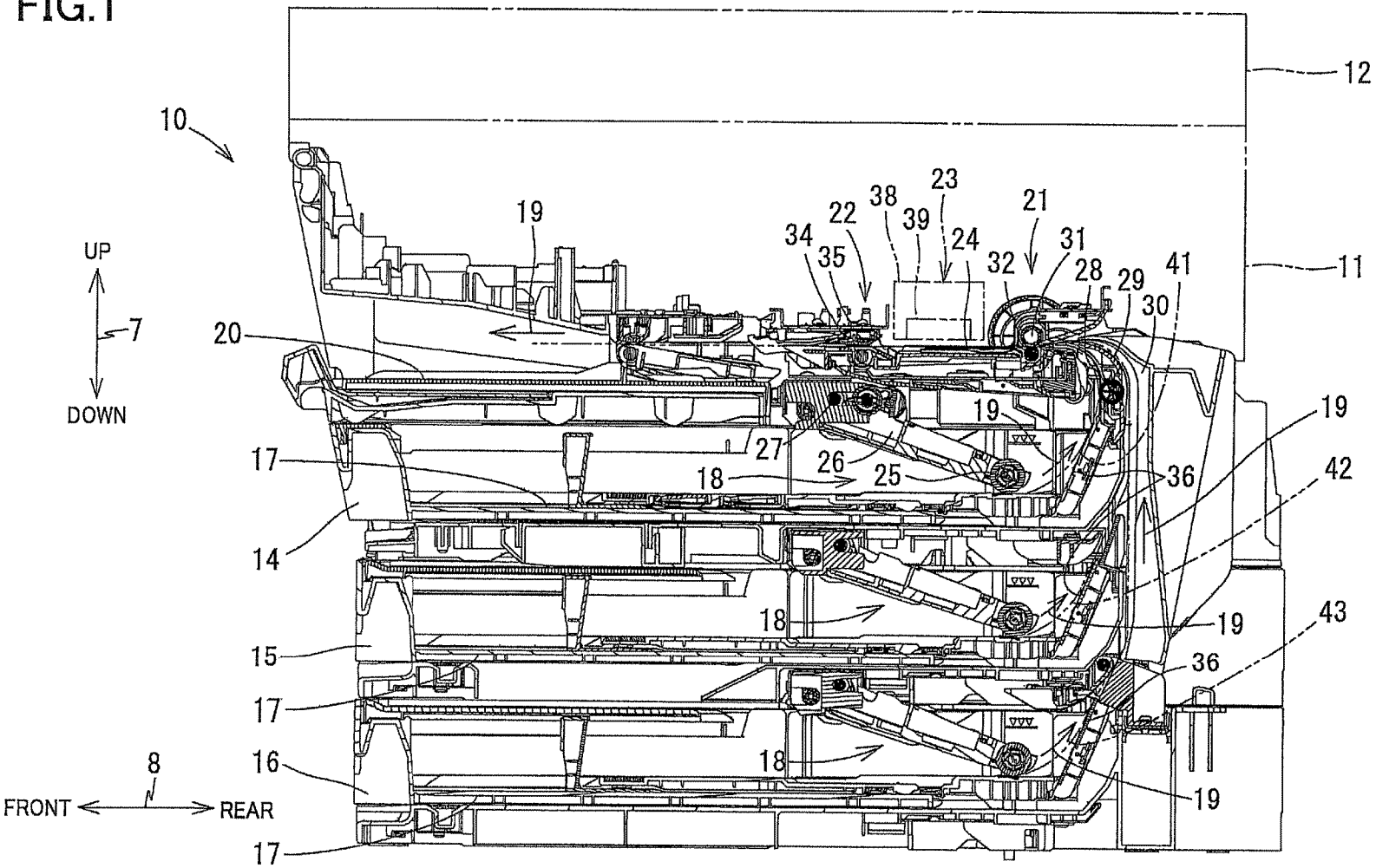
FIG. 1 is a side elevational view in cross section, illustrating a multi-function peripheral (MFP) according to the present embodiment.

Hereinafter, there will be described one embodiment by reference to the drawings. It is to be understood that the following embodiment is described only by way of example, and the disclosure may be otherwise embodied with various modifications without departing from the scope and spirit of the disclosure. A multi-function peripheral (MFP) 10 is used in a state illustrated in FIG. 1 in which the MFP 10 is disposed on a horizontal plane. In the following description, the up and down direction 7 is defined in this using state. Also, a front and rear direction 8 is defined by regarding a side of the MFP 10 on which an opening 13 is formed as a front side (a front surface). A right and left direction 9 is defined in a state in which the MFP 10 is viewed from the front. The up and down direction 7, the front and rear direction 8, and the right and left direction 9 are orthogonal to each other. A direction in which a first supplier 14, a second supplier 15, and a third supplier 16 are inserted into and removed from the MFP 10 is defined as the front and rear direction 8. A direction orthogonal to the up and down direction 7 and the front and rear direction 8 is defined as the right and left direction 9. In the present embodiment, the up and down direction 7 coincides with the vertical direction, and the front and rear direction 8 and the right and left direction 9 coincide with the horizontal direction in the using state.

There will be explained the MFP 10 according to the present embodiment.

Overall Configuration of MFP 10

As illustrated in FIG. 1, the MFP 10 (as one example of an image recording apparatus) includes a printing section 11 and a scanning section 12. The printing section 11 is a device for recording an image on a sheet using an ink-jet recording method. The scanning section 12 is a device for scanning an image formed on a document and obtaining image information. In addition to the printing function of the printing section 11 and the scanning function of the scanning section 12, the MFP 10 may have other functions such as a facsimile function.

Printing Section 11

As illustrated in FIG. 1, the printing section 11 includes a sheet-discharge tray 20, a first conveyor 21, a second conveyor 22, an image recorder 23, a platen 24, the first supplier 14, the second supplier 15, and the third supplier 16. The first supplier 14, the second supplier 15, and the third supplier 16 are arranged in this order from above.

Sheet-Discharge Tray 20

As illustrated in FIG. 1, the sheet-discharge tray 20 is disposed in a front portion of the printing section 11 to support a sheet with an image recorded by the image recorder 23.

First Supplier 14, Second Supplier 15, and Third Supplier 16

As illustrated in FIG. 1, each of the first supplier 14, the second supplier 15, and the third supplier 16 is configured to store sheets and supply them one by one toward the image recorder 23. The first supplier 14, the second supplier 15, and the third supplier 16 principally have the same configuration. Each of the first supplier 14, the second supplier 15, and the third supplier 16 includes a sheet-supply tray 17, a sheet supplier 18, and a separating plate 36. Here, a common configuration of the first supplier 14, the second supplier 15, and the third supplier 16 will be explained, taking the first supplier 14 as one example.

Sheet-Supply Tray 17

As illustrated in FIG. 1, the sheet-supply tray 17 accommodates sheets stacked on each other.

Sheet Supplier 18

As illustrated in FIG. 1, the sheet supplier 18 includes a sheet-supply roller 25, a sheet-supply arm 26, and a shaft 27. The sheet-supply roller 25 is rotatably supported at a distal end portion of the sheet-supply arm 26. Forward rotation of the sheet-supply roller 25 is caused by a supply motor, not illustrated. The sheet-supply arm 26 is pivotably supported by the shaft 27 that is supported by a third frame 50 which will be described below. The sheet-supply arm 26 is urged by its own weight or an elastic force of an urging member such as a spring so as to pivot toward the first supplier 14. The sheet supplier 18 of the second supplier 15 and the sheet supplier 18 of the third supplier 16 have the same configuration as that of the sheet supplier 18 of the first supplier 14.

The forward rotation of the sheet-supply roller 25 is rotation that rotates the sheet-supply roller 25 such that the sheet-supply roller 25 supplies the sheet in a conveying direction 19. In the following description, the forward rotation also indicates rotation for conveying the sheet in the conveying direction 19, for rollers other than the sheet-supply roller 25.

Separating Plate 36

Figure 2:
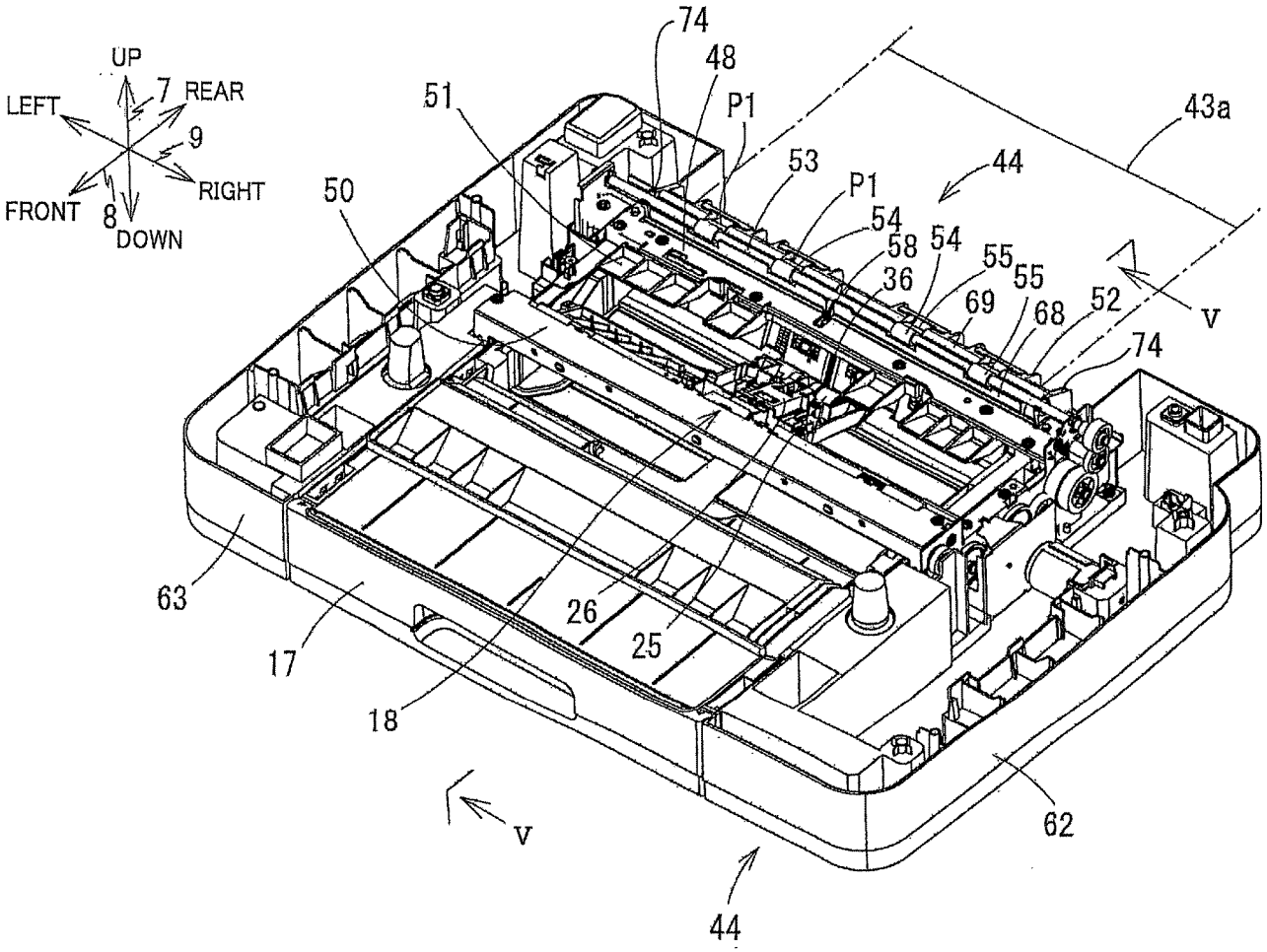
FIG. 2 is a perspective view of a third supplier viewed from a front right side thereof.

As illustrated in FIGS. 1 and 2, the separating plate 36 is located at a rear of the sheet supplier 18. A front surface of the separating plate 36 is flush with a third guide surface 86 of a third guide member 59 which will be described below and inclined with respect to the front and rear direction 8. A plurality of separating pieces 36*a* (see FIG. 6) protrude from the front surface of the separating plate 36. The separating pieces 36*a* are arranged in the up and down direction 7.

When the sheet-supply roller 25 of the sheet supplier 18 applies a force to an uppermost one of the sheets on the sheet-supply tray 17 in the conveying direction 19, the sheets on the sheet-supply tray 17 are pressed against the separating plate 36. As a result, an edge of each of the sheets enters in between corresponding two of the separating pieces 36*a* protruding from the separating plate 36, making it impossible for the sheets to move in the up and down direction 7. When a force is further applied to the uppermost sheet in the conveying direction 19, the uppermost sheet is separated from the other sheets and supplied along a first conveyance path 41. In the manner described above, the sheet supplier 18 of the first supplier 14 cooperates with the separating plate 36 to supply each of the sheets stacked on the sheet-supply tray 17, toward the first conveyance path 41.

First Conveyance Path 41, Second Conveyance Path 42, and Third Conveyance Path 43

As illustrated in FIG. 1, the printing section 11 includes the first conveyance path 41, a second conveyance path 42, and a third conveyance path 43 as paths through which the sheet is conveyed. The first conveyance path 41 extends upward from a rear end portion of the first supplier 14, makes an upward U-turn so as to extend frontward, and extends to the sheet-discharge tray 20 via a space formed between the image recorder 23 and the platen 24. The second conveyance path 42 extends upward from a rear end portion of the second supplier 15, makes an upward U-turn so as to extend frontward, merges with the first conveyance path 41, and extends to the sheet-discharge tray 20 via the space formed between the image recorder 23 and the platen 24. The third conveyance path 43 extends upward from the rear end portion of the third supplier 16, merges with the second conveyance path 42, makes an upward U-turn so as to extend frontward, and extends to the sheet-discharge tray 20 via the space formed between the image recorder 23 and the platen 24. The conveying direction 19 is indicated by the arrows illustrated along the first conveyance path 41, the second conveyance path 42, and the third conveyance path 43.

As illustrated in FIG. 1, the printing section 11 includes an inner guide member 28, an intermediate guide member 29, and an outer guide member 30. The inner guide member 28, the intermediate guide member 29, and the outer guide member 30 are arranged in this order from a front side toward a rear side. The U-turn portion of the first conveyance path 41 is formed between the inner guide member 28 and the intermediate guide member 29. The U-turn portion of the second conveyance path 42 is formed between the intermediate guide member 29 and the outer guide member 30.

First Conveyor 21 and Second Conveyor 22

As illustrated in FIG. 1, the first conveyor 21 is located upstream of the image recorder 23 in the conveying direction 19. The first conveyor 21 includes a conveying roller 31 and a pinch roller 32 opposed to each other. The pinch roller 32 is located under the conveying roller 31. The conveying roller 31 is driven by a conveying motor, not illustrated. The pinch roller 32 is rotated by rotation of the conveying roller 31. The sheet nipped by the conveying roller 31 and the pinch roller 32 is conveyed in the conveying direction 19 by the conveying roller 31 and the pinch roller 32 rotating forwardly.

The second conveyor 22 is located downstream of the image recorder 23 in the conveying direction 19. The second conveyor 22 includes a sheet-discharge roller 34 and a spur 35 opposed to each other. The spur 35 is located over the sheet-discharge roller 34. The sheet-discharge roller 34 is driven by the conveying motor, not illustrated. The spur 35 is rotated by rotation of the sheet-discharge roller 34. The sheet nipped by the sheet-discharge roller 34 and the spur 35 is conveyed in the conveying direction 19 by the sheet-discharge roller 34 and the spur 35 rotating forwardly.

Image Recorder 23

As illustrated in FIG. 1, the image recorder 23 is disposed between the first conveyor 21 and the second conveyor 22 in the conveying direction 19. The image recorder 23 includes a carriage 38 and a recording head 39. The carriage 38 is reciprocated in a main scanning direction (coinciding with the right and left direction 9 in the present embodiment).

The carriage 38 is mounted on the recording head 39. A lower surface of the recording head 39 has a multiplicity of nozzles. Distal ends of the nozzles are exposed from the lower surface of the recording head 39. The recording head 39 ejects fine ink droplets from the nozzles. During movement of the carriage 38 in the main scanning direction, the recording head 39 ejects the ink droplets toward the sheet supported on the platen 24. As a result, an image is recorded on the sheet.

Platen 24

As illustrated in FIG. 1, the platen 24 is disposed between the first conveyor 21 and the second conveyor 22 in the conveying direction 19. The image recorder 23 and the platen 24 are opposed to each other in the up and down direction 7. The image recorder 23 is located above the platen 24. The platen 24 supports a lower surface of the sheet conveyed by the first conveyor 21.

Third Supplier 16

There will be described the configuration of the third supplier 16 in detail with reference to FIGS. 2-8. As illustrated in FIG. 2, the third supplier 16 includes a main body portion 44 and the sheet-supply tray 17 supported by the main body portion 44 so as to be insertable and removable in the front and rear direction 8.

Main Body Portion 44

Figure 3:
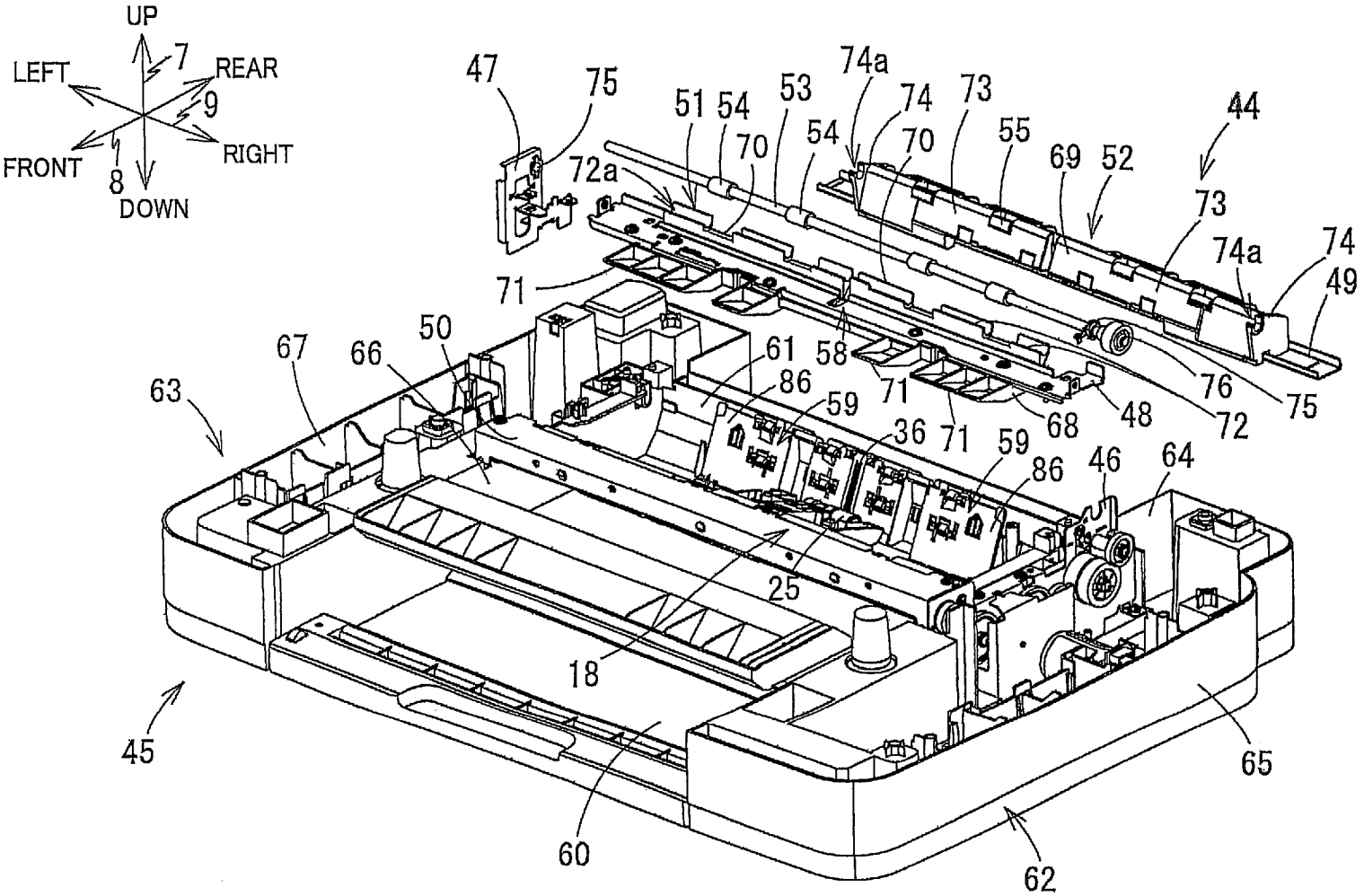
FIG. 3 is an exploded partial perspective view of a main body portion viewed from a front right side thereof.
Figure 4:
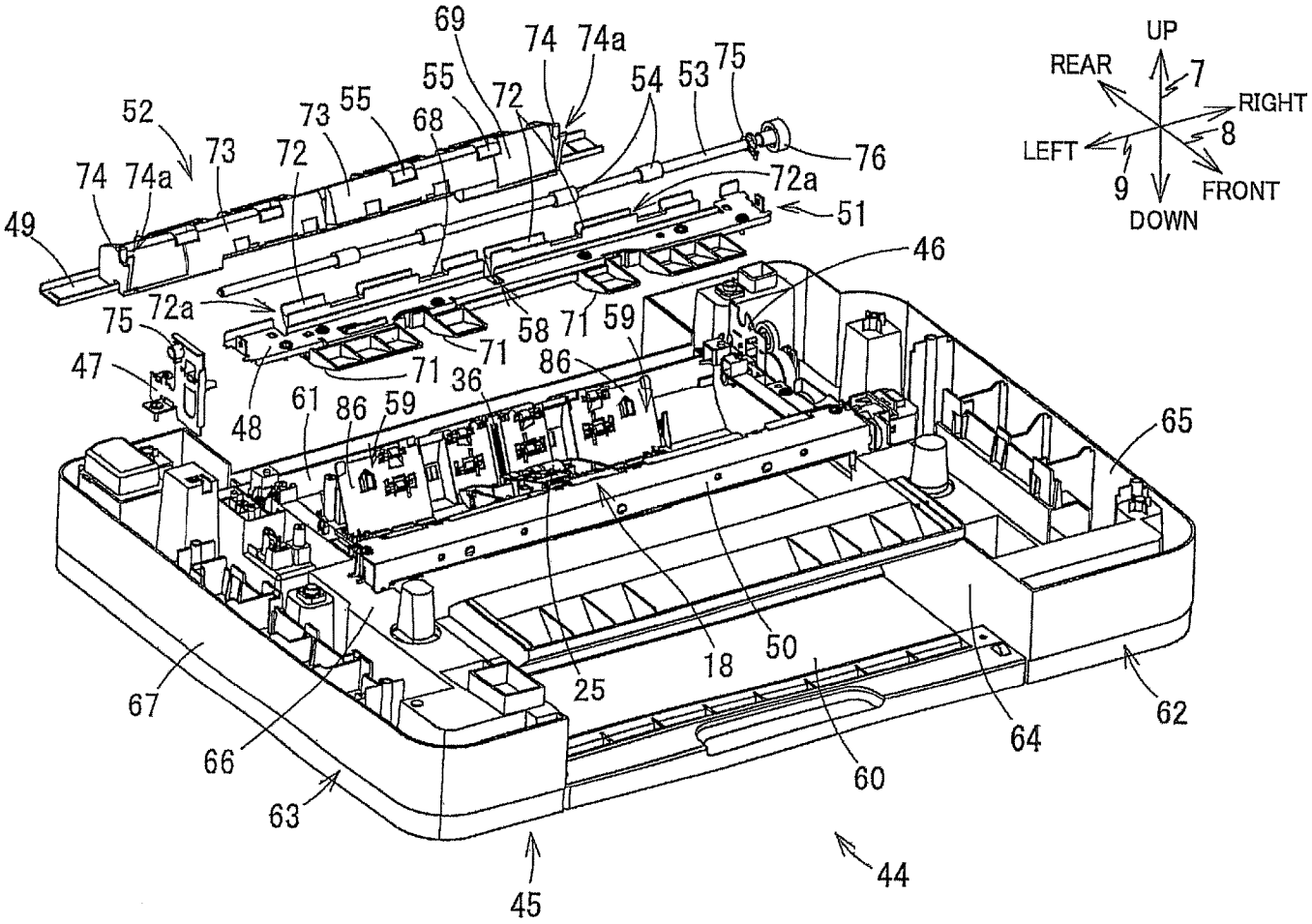
FIG. 4 is an exploded partial perspective view of the main body portion viewed from a front left side thereof.
Figure 6:
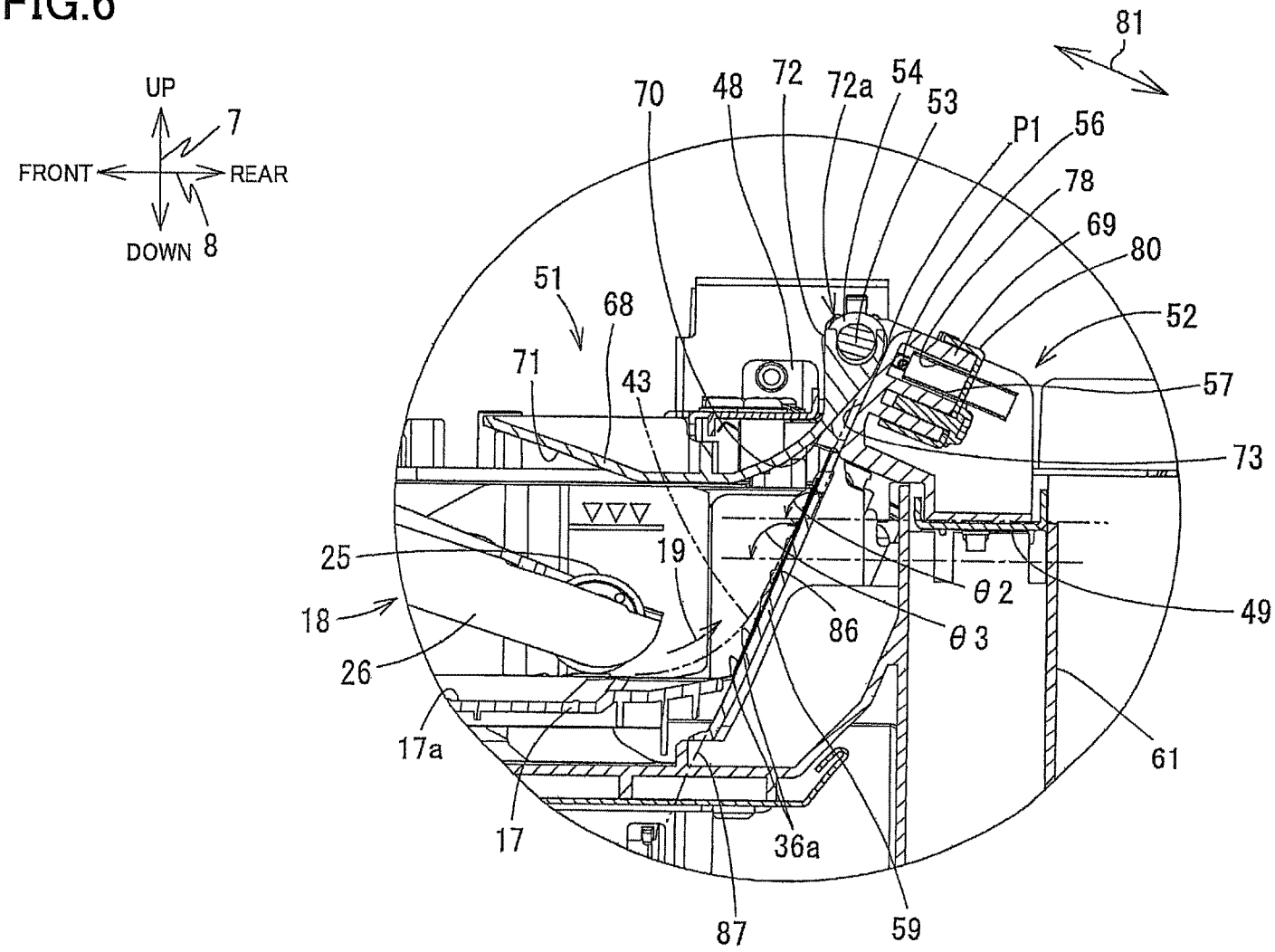
FIG. 6 is an enlarged view of a main portion of FIG. 5.

As illustrated in FIGS. 2-4, the main body portion 44 includes a casing 45, a right frame 46, a left frame 47, a first frame 48, a second frame 49, the third frame 50, a first guide member 51, a second guide member 52, a rotation shaft 53, four conveying rollers 54, four driven rollers 55, a detector 58, and the third guide member 59. As illustrated in FIG. 6, the main body portion 44 includes four support shafts 56 and eight springs 57.

Casing 45

As illustrated in FIGS. 2-4, the casing 45 includes a bottom wall 60, a rear wall 61, a right box 62, and a left box 63. The bottom wall 60 is located at a central portion of the casing 45 in the right and left direction 9 and shaped like a plate extending in the front and rear direction 8. The rear wall 61 extends upward from a rear end portion of the bottom wall 60. The right box 62 is located to the right of the bottom wall 60 and shaped like a box opening upward. The right box 62 includes a right inner wall 64 and a right outer wall 65 opposed to each other in the right and left direction 9. An accommodating chamber is formed between the right inner wall 64 and the right outer wall 65. The right outer wall 65 is located farther from the bottom wall 60 than the right inner wall 64. The accommodating chamber of the right box 62 accommodates a drive mechanism relating to driving of the sheet supplier 18. The left box 63 is located to the left of the bottom wall 60 and shaped like a box opening upward. The left box 63 includes a left inner wall 66 and a left outer wall 67 opposed to each other in the right and left direction 9. An accommodating chamber is formed between the left inner wall 66 and the left outer wall 67. The left outer wall 67 is located farther from the bottom wall 60 than the left inner wall 66. The bottom wall 60, the rear wall 61, the right box 62, and the left box 63 are formed of resin and formed integrally with each other or fixed to each other. The right box 62 and the left box 63 accommodate the drive mechanism relating to driving of the sheet supplier 18.

Right Frame 46 and Left Frame 47

As illustrated in FIGS. 2-4, the right frame 46 (as one example of a supporter and a support member) and the left frame 47 (as another example of the supporter and the support member) support the first frame 48, the second frame 49, and the rotation shaft 53. The right frame 46 and the left frame 47 are coupled to the casing 45. The right frame 46 is secured to a right surface of the right inner wall 64 of the right box 62 by screws, for example. The left frame 47 is secured to a left surface of the left inner wall 66 of the left box 63 by screws, for example. In the present embodiment, each of the right frame 46 and the left frame 47 is constituted by a bent metal plate. The right frame 46 is located at a rear portion of the right box 62 in the front and rear direction 8. The left frame 47 is located at a rear portion of the left box 63 in the front and rear direction 8.

First Frame 48

As illustrated in FIGS. 2-4, the first frame 48 is elongated in the right and left direction 9 and supports the first guide member 51. The first frame 48 is constituted by a bent metal plate in the present embodiment. The first frame 48 is located at a central portion of the right frame 46 and a front end portion of the left frame 47. The first frame 48 is coupled to the right frame 46 and the left frame 47. Right and left end portions of the first frame 48 are respectively secured to the right frame 46 and the left frame 47 by screws, for example.

Second Frame 49

As illustrated in FIGS. 2-4, the second frame 49 is elongated in the right and left direction 9 and supports the second guide member 52. The second frame 49 is constituted by a bent metal plate in the present embodiment. The second frame 49 is located at rear end portions of the right frame 46 and the left frame 47. The second frame 49 is coupled to the right frame 46 and the left frame 47. Right and left end portions of the second frame 49 are respectively secured to the right frame 46 and the left frame 47 by screws, for example.

Third Frame 50

As illustrated in FIGS. 2-4, the third frame 50 is elongated in the right and left direction 9 and supports the sheet supplier 18. The shaft 27 of the sheet supplier 18 is rotatably supported by the third frame 50. The sheet-supply arm 26 of the sheet supplier 18 extends to an area located at a rear of the third frame 50. The sheet-supply roller 25 is provided at a rear end portion of the sheet-supply arm 26, i.e., one of opposite end portions of the sheet-supply arm 26, which one is farther from the shaft 27 supported by the third frame 50 than the other end portion. The third frame 50 is constituted by a bent metal plate in the present embodiment. The third frame 50 is located at generally the center of each of the right box 62 and the left box 63 in the front and rear direction 8. The third frame 50 is coupled to the right frame 46 and the left box 63. Right and left end portions of the third frame 50 are respectively secured to central portions of a front end portion of the right frame 46 and the left inner wall 66 of the left box 63 by screws, for example.

First Guide Member 51

As illustrated in FIGS. 3-7, the first guide member 51 extends in the right and left direction 9. The first guide member 51 is formed of resin in the present embodiment. An upper surface of the first guide member 51 is in contact with a lower surface of the first frame 48. The first guide member 51 is secured to the first frame 48 by screws, for example.

Figure 5:
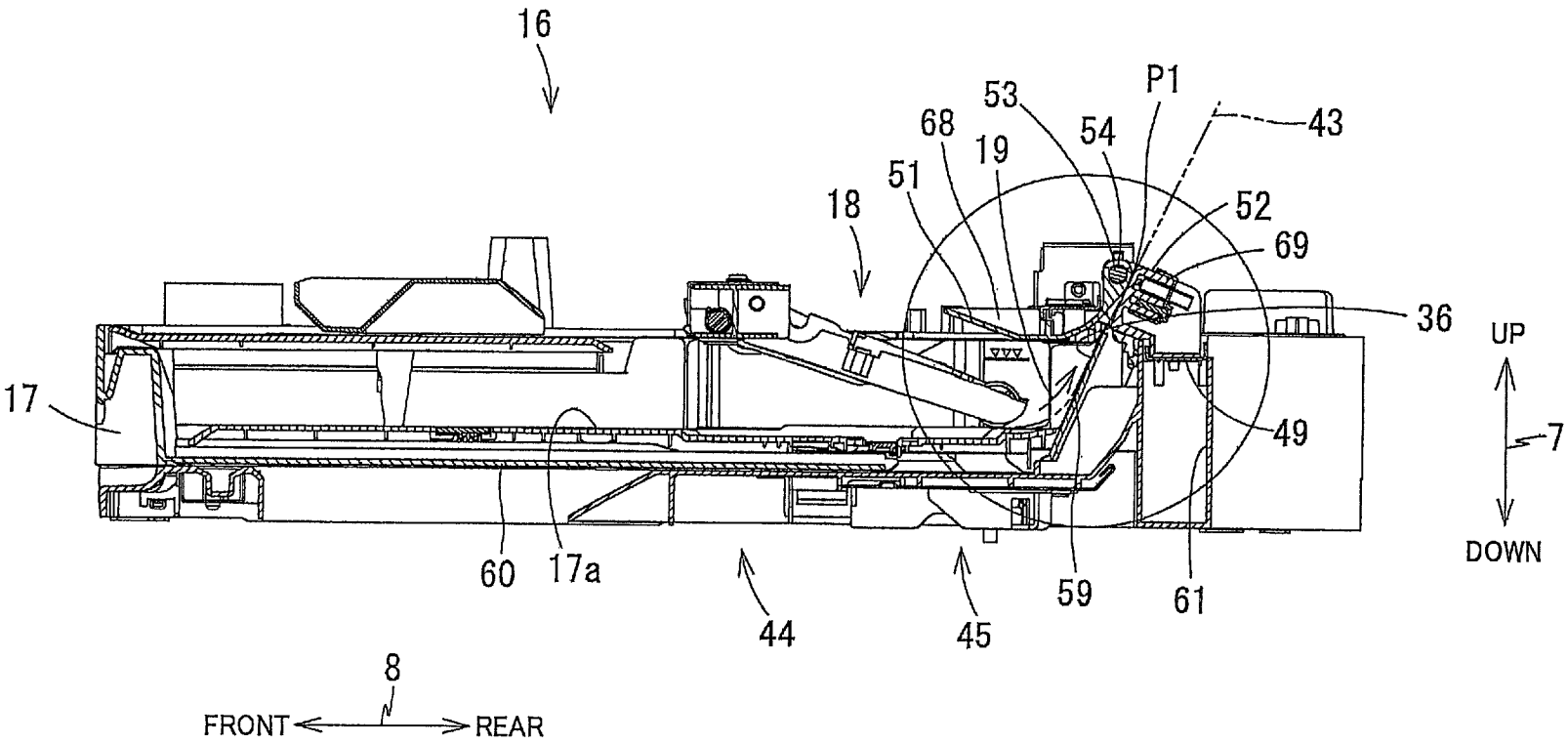
FIG. 5 is a cross-sectional view taken along line V-V in FIG. 2.
Figure 7:
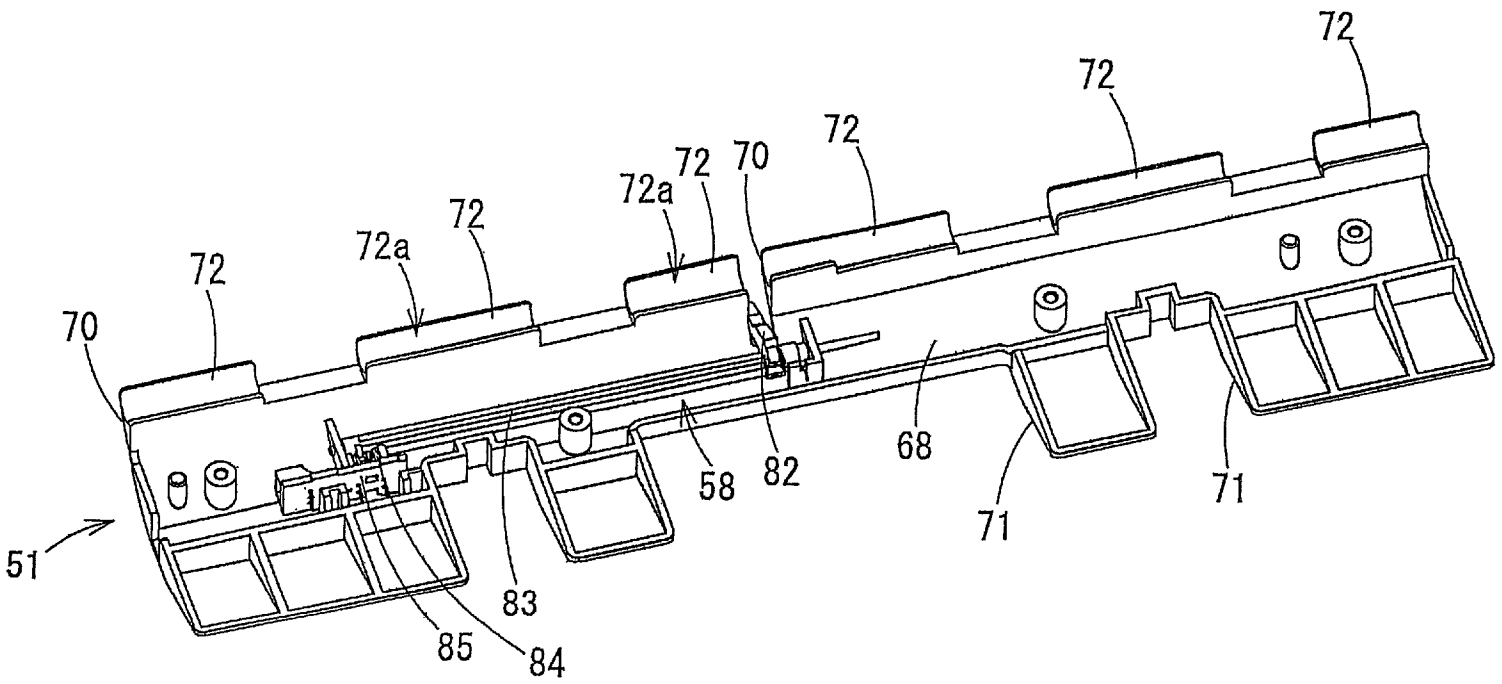
FIG. 7 is a perspective view of a first guide member viewed from a front left side thereof and FIG. 8 is a perspective view of a second guide member viewed from a rear right side thereof.
Figure 8:
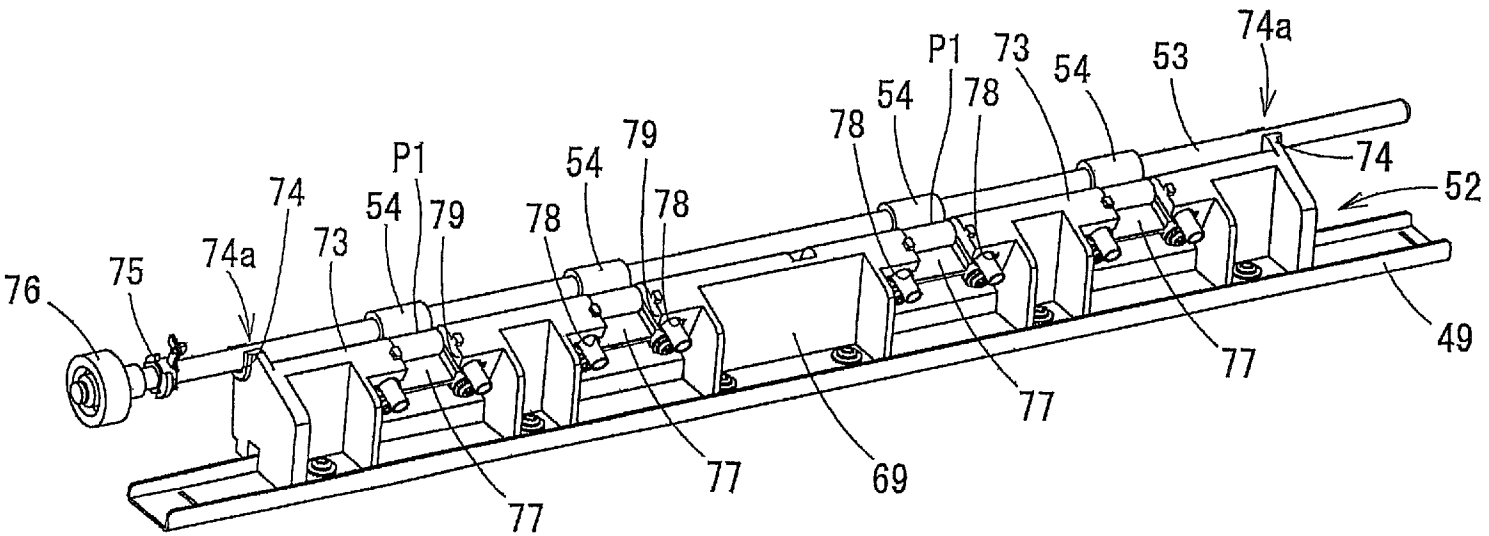

As illustrated in FIG. 5, the first guide member 51 is located over a rear end portion of the sheet-supply tray 17. As illustrated in FIGS. 3-7, the first guide member 51 includes a first guide main body 68 and six first engaging portions 72. The first guide main body 68 includes two first guide surfaces 70 and four fourth guide surfaces 71. As illustrated in FIGS. 7 and 8, the outer shape of the first guide main body 68 is a dome shape expanded downward when the first guide main body 68 is viewed in the right and left direction 9. The first guide surfaces 70 are formed on a lower surface of a rear portion of the first guide main body 68 and a rear surface of the first guide main body 68. The fourth guide surfaces 71 are formed on a front portion of a lower surface of the first guide main body 68.

As illustrated in FIG. 6, the first guide surfaces 70 guide the sheet supplied by the sheet supplier 18 and partly define the third conveyance path 43. The first guide surfaces 70 curve upward while extending rearward. Each of the first guide surfaces 70 has an arc-shape when viewed in the right and left direction 9.

The third conveyance path 43 in the third supplier 16 curves upward while extending rearward. The first guide surfaces 70 are located on an inner side of the third conveyance path 43. That is, the first guide surfaces 70 are located on one of opposite sides of the third conveyance path 43, which one is nearer to the center of the curvature of the third conveyance path 43 than the other.

As illustrated in FIGS. 5 and 6, the fourth guide surfaces 71 are located on an upper side of an upper surface 17*a* of the sheet-supply tray 17 and curved downward while extending rearward. Each of the fourth guide surfaces 71 has an arc-shape when viewed in the right and left direction 9. A rear end of each of the fourth guide surfaces 71 is continuous to a front end of a corresponding one of the first guide surfaces 70.

As illustrated in FIGS. 3-7, each of the first engaging portions 72 extends upward from an upper surface of a rear end portion of the first guide main body 68 and has an opening 72*a* facing upward. As illustrated in FIG. 6, each of the first engaging portions 72 has a U-shape when viewed in the right and left direction 9. The rotation shaft 53 of the conveying rollers 54 is engaged in the first engaging portions 72. That is, the first guide member 51 has recesses each opening upward and having a U-shape in cross section when viewed in the right and left direction 9, and the rotation shaft 53 in inserted in the recesses. A surface of the rotation shaft 53 engaged in the first engaging portions 72 is partly exposed from the openings 72*a*.

FIGS. 3, 4, and 7, the six first engaging portions 72 are arranged in the right and left direction 9. The six first engaging portions 72 are located between the right frame 46 and the left frame 47 in the right and left direction 9.

Second Guide Member 52

As illustrated in FIGS. 3-6 and 8, the second guide member 52 extends in the right and left direction 9. The second guide member 52 is formed of resin in the present embodiment. A lower surface of the second guide member 52 is in contact with an upper surface of the second frame 49. The second guide member 52 is secured to the second frame 49 by screws, for example.

As illustrated in FIGS. 5 and 6, the second guide member 52 is located over the rear wall 61 of the casing 45 and extends from the rear wall 61 in an upper and front direction. As illustrated in FIGS. 3-6 and 8, the second guide member 52 includes a second guide main body 69 and two second engaging portions 74. The second guide main body 69 has two second guide surfaces 73. As illustrated in FIGS. 7 and 8, the outer shape of the second guide main body 69 is a trapezoid shape when the second guide main body 69 is viewed in the right and left direction 9. The second guide surfaces 73 are formed on a front surface of the second guide main body 69.

As illustrated in FIG. 6, the second guide surfaces 73 guide the sheet supplied by the sheet supplier 18 and partly define the third conveyance path 43. The second guide surfaces 73 are respectively opposed to the first guide surfaces 70. Each of the second guide surfaces 73 is a flat surface inclined with respect to the front and rear direction 8 (as one example of the horizontal direction). That is, each of the second guide surfaces 73 is a flat surface inclined with respect to the horizontal plane. The second guide surfaces 73 are located on an outer side of the third conveyance path 43. That is, the second guide surfaces 73 are located on the other of the opposite sides of the third conveyance path 43, which is farther from the center of the curvature of the third conveyance path 43 than the one of the opposite sides.

As illustrated in FIGS. 3, 4, and 8, each of the second engaging portions 74 extends upward from an upper surface of a front end portion of the second guide main body 69 and has an opening 74*a* facing upward. As illustrated in FIGS. 3 and 8, each of the second engaging portions 74 has a U-shape when viewed in the right and left direction 9. The rotation shaft 53 of the conveying rollers 54 is engaged in the second engaging portions 74. That is, the second guide member 52 has recesses each opening upward and having a U-shape in cross section when viewed in the right and left direction 9, and the rotation shaft 53 in inserted in the recesses. A surface of the rotation shaft 53 engaged in the second engaging portions 74 is partly exposed from the openings 74*a*. As illustrated in FIG. 2, the rotation shaft 53 is engaged with the first engaging portions 72 and the second engaging portions 74. Inner surfaces of the respective first engaging portions 72 and inner surfaces of the respective second engaging portions 74 are located on a surface of an imaginary circular cylinder extending along the axial direction of the rotation shaft 53.

As illustrated in FIGS. 3, 4, and 8, the two second engaging portions 74 are arranged along the right and left direction 9. The two second engaging portions 74 are located between the right frame 46 and the left frame 47 in the right and left direction 9. As illustrated in FIG. 2, the two second engaging portions 74 are located outside a widthwise region 43*a* of the third conveyance path 43. The widthwise region 43*a* is a region of the third conveyance path 43 in the right and left direction 9. The widthwise region 43*a* in the right and left direction 9 is slightly wider in the right and left direction 9 than a sheet having the largest width among the sheets conveyable in the printing section 11. That is, during conveyance of the sheet having the largest width in the right and left direction 9 (the widthwise direction) among the sheets conveyable through the third conveyance path 43, the two second engaging portions 74 are located not within a region between opposite edges of the sheet in the right and left direction 9 but outside the region between the opposite edges of the sheet in the right and left direction 9. Also, the six first engaging portions 72 are located between the two second engaging portions 74 in the right and left direction 9.

Rotation Shaft 53

As illustrated in FIGS. 3-6 and 8, the rotation shaft 53 is a shaft member extending in the right and left direction 9. As illustrated in FIGS. 3 and 4, two bearings 75 are respectively provided on opposite end portions of the rotation shaft 53. The bearings 75 support the rotation shaft 53 such that the rotation shaft 53 is rotatable. The bearing 75 are respectively fixed to the right frame 46 and the left frame 47. A drive gear 76 is fixed to a right end portion of the rotation shaft 53. The drive gear 76 receives a driving force from a motor, not illustrated, and rotates the rotation shaft 53.

The first engaging portions 72 of the first guide member 51 and the second engaging portions 74 of the second guide member 52 are engaged with the rotation shaft 53. The rotation shaft 53 is rotatably supported not only by the right frame 46 and the left frame 47 but also by the first guide member 51 and the second guide member 52.

Conveying Rollers 54

As illustrated in FIGS. 3-6 and 8, the four conveying rollers 54 are fixed to the rotation shaft 53. The four conveying rollers 54 are spaced apart from each other in the axial direction of the rotation shaft 53. When the rotation shaft 53 is driven, the four conveying rollers 54 are rotated.

As illustrated in FIGS. 3 and 4, each of four of the six first engaging portions 72 of the first guide member 51 is located between corresponding adjacent two of the conveying rollers 54. The other two first engaging portions 72 are located outside of the four conveying rollers 54 in the right and left direction 9.

Driven Rollers 55

As illustrated in FIGS. 3, 4, and 8, the four driven rollers 55 are respectively opposed to the four conveying rollers 54.

Support Shafts 56 and Springs 57

As illustrated in FIGS. 6 and 8, the support shafts 56 (each as one example of a roller supporter) and the springs 57 (each as one example of an urging member) are provided on the second guide member 52. The main body portion 44 includes the four support shafts 56. The driven rollers 55 are rotatably supported by the respective support shafts 56. As illustrated in FIG. 8, the second guide member 52 has four recessed portions 77 opening upward. The driven rollers 55 are provided in the respective recessed portions 77. As illustrated in FIG. 6, the second guide member 52 has spring chambers 78 each accommodating an end portion of a corresponding one of the support shafts 56 and a corresponding one of the springs 57. As illustrated in FIG. 8, each of the spring chambers 78 extends rearward and has an elongated hole 79 formed in a side wall of a corresponding one of the recessed portions 77. Two of the elongated holes 79 are formed in opposite side walls defining a corresponding one of the recessed portions 77. Two of the spring chambers 78 are respectively located on right and left sides of a corresponding one of the recessed portions 77. A closing member 80 closing rear portions of the spring chambers 78 is fixed to the second guide member 52.

In each of the spring chambers 78, as illustrated in FIG. 6, the support shaft 56 is located at a front portion of the spring chamber 78, and the spring 57 is located between the support shafts 56 and the closing member 80. A direction connecting between the axis of the rotation shaft 53 of the conveying rollers 54 and the axis of the support shafts 56 of the driven rollers 55 when the rotation shaft 53 and the support shafts 56 are viewed in the right and left direction 9 is an opposed direction 81 in which the conveying rollers 54 and the driven rollers 55 are opposed to each other. The longitudinal direction of each of the elongated holes 79 formed in the second guide member 52 substantially coincides with the opposed direction 81. Thus, the driven rollers 55 are urged by the respective springs 57 toward the respective conveying rollers 54 in the opposed direction 81 and movable away from the respective conveying rollers 54 along the respective elongated holes 79. The support shafts 56 rotatably supporting the respective driven rollers 55 are supported movably with respect to the second guide member 52. Thus, the driven rollers 55 are rotatably supported by the second guide member 52.

The opposed direction 81 is a direction orthogonal to the right and left direction 9 and inclined with respect to the front and rear direction 8 and the up and down direction 7. The opposed direction 81 includes a lower front direction and an upper rear direction. The openings 72*a* of the first engaging portions 72 and the openings 74*a* of the second engaging portions 74 are oriented in the up direction, i.e., a direction not coinciding with the opposed direction 81.

As illustrated in FIGS. 2 and 8, the driven rollers 55 are urged by the respective springs 57 so as to contact the respective conveying rollers 54, and accordingly each of the driven rollers 55 and a corresponding one of the conveying rollers 54 cooperate with each other to nip and convey the sheet at a nip position P1. The nip position P1 is a position at which the conveying roller 54 and the driven roller 55 are in contact with each other.

Detector 58

As illustrated in FIGS. 2-4 and 7, the detector 58 is provided on the first guide member 51. As illustrated in FIG. 7, the detector 58 includes a contact arm 82, an arm shaft 83, a detection arm 84, and an optical sensor 85. The contact arm 82 is protrutable in the third conveyance path 43. The arm shaft 83 is rotatably supported by the upper surface of the first guide member 51. The axial direction of the arm shaft 83 coincides with the right and left direction 9. The contact arm 82 is fixed to one end of the arm shaft 83, and the detection arm 84 is fixed to the other end of the arm shaft 83. Each of the contact arm 82 and the detection arm 84 extends from the arm shaft 83 in a direction orthogonal to the axial direction of the arm shaft 83. The direction in which the contact arm 82 extends is different from the direction in which the detection arm 84 extends. The optical sensor 85 includes a light emitter and a light receiver. The detection arm 84 pivotable about the axis of the arm shaft 83 is capable of intercepting a light path extending from the light emitter to the light receiver of the optical sensor 85.

The contact arm 82 protrudes in the third conveyance path 43 by its own weight in a state in which no sheet is present in the third conveyance path 43. When the contact arm 82 is located at a lower position, the detection arm 84 is located at an upper position. In this state, the detection arm 84 does not intercept the light path formed by the optical sensor 85. In a state in which a sheet is present in the third conveyance path 43, the contact arm 82 is pressed by the sheet and located at an upper position. When the contact arm 82 is located at the upper position, the detection arm 84 is located at a lower position. In this state, the detection arm 84 intercepts the light path formed by the optical sensor 85. Thus, the light path formed by the optical sensor 85 is maintained or intercepted, depending upon the presence or absence of the sheet in the third conveyance path 43. That is, the optical sensor 85 is capable of outputting a signal indicating the presence or absence of the sheet.

As illustrated in FIGS. 3, 4, and 7, the contact arm 82 is located at a central portion of the first guide member 51 in the up and down direction 7 and the front and rear direction 8. The rotation shaft 53 of the conveying rollers 54 is located at an upper rear end portion of the first guide member 51. The contact arm 82 is located in the third conveyance path 43 at a position located upstream of the nip position P1 (at which the conveying rollers 54 and the driven rollers 55 nip the sheet) in the conveying direction 19. Accordingly, the presence or absence of the sheet is detected by the detector 58 in the third conveyance path 43 at a position located upstream of the nip position P1 in the conveying direction 19.

Third Guide Member 59

As illustrated in FIGS. 3-6, the third guide member 59 is fixed to the bottom wall 60 and the rear wall 61. The third guide member 59 has the third guide surface 86 partly defining the third conveyance path 43. The third guide surface 86 guides the sheet supplied by the sheet-supply roller 25, toward the first guide member 51 and the second guide member 52.

As illustrated in FIG. 6, when viewed in the right and left direction 9, the third guide surface 86 is an inclined surface intersecting the front and rear direction 8. That is, the third guide surface 86 is an inclined surface intersecting the horizontal plane. When viewed in the up and down direction 7, the third guide surface 86 may be any of a flat surface and a curved surface protruding frontward. An imaginary line 87 is a straight line extending through a position that is a position located on the third guide surface 86 in the right and left direction 9. The imaginary line 87 is included in a vertical plane orthogonal to the right and left direction 9. The imaginary line 87 is inclined with respect to the front and rear direction 8 and the up and down direction 7. The imaginary line 87 extends from the third guide surface 86 toward the first guide member 51 and the second guide member 52. The imaginary line 87 extends through a position that is located between one of the first guide surfaces 70 and a corresponding one of the second guide surfaces 73 in the opposed direction 81.

As illustrated in FIG. 6, the third guide surface 86 of the third guide member 59 is located in front of the second guide surfaces 73 of the second guide member 52. The third guide surface 86 is not continuous to the second guide surfaces 73. Thus, a step in the front and rear direction 8 is formed between the third guide surface 86 and the second guide surfaces 73. An obtuse angle θ2 at which the second guide surfaces 73 intersect the front and rear direction 8 is substantially equal to an obtuse angle θ3 at which the third guide surface 86 intersects the front and rear direction 8. That is, the obtuse angle θ2 at which the second guide surfaces 73 intersect the horizontal plane is substantially equal to the obtuse angle θ3 at which the third guide surface 86 intersects the horizontal plane.

Effects

In the MFP 10 according to the present embodiment, the first guide member 51 and the second guide member 52 are engaged with the rotation shaft 53 fixed to the conveying rollers 54. This keeps a positional relationship between each of the first guide surfaces 70 of the first guide member 51 and the corresponding second guide surface 73 of the second guide member 52. The position of the sheet guided by the first guide surfaces 70 and the second guide surfaces 73 does not change, whereby the sheet is appropriately conveyed to the nip position P1 at which the sheet is nipped by the conveying rollers 54 and the driven rollers 55.

Since the driven rollers 55 are supported by the second guide member 52, the nip position P1 at which the sheet is nipped by the conveying rollers 54 supported by the first guide member 51 and the driven rollers 55 supported by the second guide member 52 is positioned and does not change. This keeps a positional relationship among the first guide surfaces 70, the second guide surfaces 73, and the nip position P1. The sheet guided by the first guide surfaces 70 and the second guide surfaces 73 is appropriately guided to the nip position P1 without positioning the first guide surfaces 70 and the second guide surfaces 73 and positioning the nip position P1, individually. Also, this configuration stabilizes the nipping force of the conveying rollers 54 and the driven rollers 55. Thus, the sheet is held by the conveying rollers 54 without separated from the conveying rollers 54, so that the sheet is conveyed to a downstream side in the conveying direction 19 by the conveying rollers 54.

The openings 72*a* of the first engaging portions 72 and the openings 74*a* of the second engaging portions 74 are not oriented in the opposed direction 81. Thus, even when a force is applied to the rotation shaft 53 in a direction in which the conveying rollers 54 and the driven rollers 55 are moved toward and away from each other, the rotation shaft 53 is not easily separated from the first engaging portions 72 and the second engaging portions 74.

The second engaging portions 74 are located outside the conveying rollers 54 and the third conveyance path 43 in the axial direction of the rotation shaft 53, thereby preventing the second engaging portions 74 from interfering with the third conveyance path 43.

The detector 58 is supported by the first guide member 51. Thus, the detector 58 is positioned with respect to the first guide member 51. Accordingly, when compared with a case where the detector 58 is not positioned with respect to the first guide member 51, it is possible to prevent reduction in accuracy of detection of the sheet by the detector 58.

The imaginary line 87 included in the third guide surface 86 extends through a position located between the first guide surfaces 70 and the second guide surfaces 73. Thus, the sheet supplied from the sheet-supply roller 25 in the conveying direction is not caught by the second guide member 52 when guided from the third guide surface 86 to the second guide surfaces 73. This configuration prevents a jam of the sheet caught by the second guide member 52.

The obtuse angle θ2 at which the second guide surfaces 73 intersect the horizontal direction is substantially equal to the obtuse angle θ3 at which the third guide surface 86 intersects the horizontal direction. Thus, the sheet conveyed by the sheet-supply roller 25 and guided along the third guide surface 86 is guided along the second guide surfaces 73 connected to the third guide surface 86, without being pushed toward the first guide surfaces 70 opposed to the third guide surface 86 with the third conveyance path 43 therebetween. This configuration reduces the jam of the sheet when compared with a case where the sheet is guided from the third guide surface 86 to the first guide surfaces 70 and brought into contact with the first guide surfaces 70.

The fourth guide surfaces 71 located on an upper side of the upper surface 17*a* of the sheet-supply tray 17 extend toward the first guide surfaces 70. Thus, even in the case where the sheet-supply tray 17 is filled with the sheets, and an uppermost one of the sheets is in contact with the fourth guide surfaces 71, the sheet is supplied in the conveying direction without hindered by the first guide member 51.

The first frame 48 supporting the first guide member 51 and the second frame 49 supporting the second guide member 52 are coupled to the right frame 46 and the left frame 47. Thus, the first guide member 51 and the second guide member 52 are positioned accurately. The first guide member 51 and the second guide member 52 are engaged with the rotation shaft 53 of the conveying rollers 54, thereby accurately positioning the rotation shaft 53, the first guide member 51, and the second guide member 52 to each other.

The third frame 50 supporting the sheet-supply roller 25 rotatably via the sheet-supply arm 26 and the shaft 27 is coupled to the right frame 46 and the left frame 47. Thus, the sheet-supply roller 25 supported by the third frame 50 is accurately positioned with respect to the conveying rollers 54 supported by the right frame 46 and the left frame 47 via the first guide member 51 and the rotation shaft 53.

The driven rollers 55 are urged toward the respective conveying rollers 54. Thus, the sheet is appropriately held at the nip position P1 without separating from the conveying rollers 54.

Modifications

In the MFP 10 according to the present embodiment, the first engaging portions 72 engaged with the rotation shaft 53 have the respective openings 72*a*, and the second engaging portions 74 engaged with the rotation shaft 53 have the respective openings 74*a*, but the present disclosure is not limited to this configuration. Each of the first engaging portions 72 and the second engaging portions 74 engaged with the rotation shaft 53 may be an annular bearing that supports the rotation shaft 53 rotatably.

In the present embodiment, the openings 72*a* of the first engaging portions 72 and the openings 74*a* of the second engaging portions 74 are oriented upward and are not oriented in the opposed direction 81 in which the conveying rollers 54 and the driven rollers 55 are opposed to each other, but the orientation of the respective openings 72*a*, 74*a* is not limited to this orientation. The orientation of the openings 72*a*, 74*a* may be any direction unless the orientation is the opposed direction 81.

While the first guide member is located on an inner side of the curved third conveyance path 43, and the second guide member 52 supporting the driven rollers 55 is located on an outer side of the curved third conveyance path 43 in the present embodiment, the MFP 10 may be configured such that the first guide member is located on an outer side of the third conveyance path 43, and the second guide member 52 is located on an inner side of the third conveyance path 43.

The detector 58 is supported by the first guide member 51 in the present embodiment and may be supported by the second guide member 52, or another frame or member in the MFP 10.

While the third guide member 59 configured to guide the sheet toward the first guide member 51 and the second guide member 52 has the third guide surface 86 as the inclined surface in the present embodiment, the third guide surface 86 at least needs to be a surface defining the third conveyance path 43. The third guide surface 86 may be a curved surface curved upward while extending rearward and having an arc-shape protruding rearward and downward when viewed in the right and left direction 9. In this case, a tangent to an upper end of the third guide surface 86 when viewed in the right and left direction 9 passes through a position that is located between a corresponding one of the first guide surfaces 70 and the corresponding second guide surface 73 in the opposed direction 81.

While the obtuse angle θ2 at which the second guide surfaces 73 intersect the horizontal direction is substantially equal to the obtuse angle θ3 at which the third guide surface 86 intersects the horizontal direction in the present embodiment, the obtuse angle θ2 of the second guide surfaces 73 may be different from the obtuse angle θ3 of the third guide surface 86.

The first guide member 51 has the fourth guide surfaces 71 located above the upper surface 17*a* of the sheet-supply tray 17 in the present embodiment but need not have the fourth guide surfaces 71.

In the present embodiment, the first frame 48 supporting the first guide member 51, the second frame 49 supporting the second guide member 52, and the third frame 50 supporting the sheet-supply roller 25 are coupled to the right frame 46 and the left frame 47, but the present disclosure is not limited to this configuration. The first frame 48, the second frame 49, and the third frame 50 may be directly or indirectly secured to the casing 45 and need not be directly coupled to the right frame 46 and the left frame 47.

What is claimed is:

1. A conveying apparatus, comprising:

a rotation shaft configured to be driven to rotate;

a conveying roller secured to the rotation shaft;

a driven roller opposed to the conveying roller and configured to cooperate with the conveying roller to nip a sheet at a nip position to convey the sheet;

a supporter supporting the rotation shaft such that the rotation shaft is rotatable; and a first guide and a second guide defining a conveyance path that guides the sheet from an upstream side of the nip position in a conveying direction toward the nip position, the first guide and the second guide being opposed to each other in an opposed direction orthogonal to each of the conveying direction and an axial direction of the rotation shaft, wherein the first guide comprises: a first guide surface defining the conveyance path; and a first engaging portion engaged with the rotation shaft at a position different from a position of the supporter in the axial direction of the rotation shaft, and wherein the second guide comprises: a second guide surface defining the conveyance path; and a second engaging portion engaged with the rotation shaft at a position different from the position of the supporter and a position of the first engaging portion in the axial direction of the rotation shaft.

2. The conveying apparatus according to claim 1, wherein the second guide supports the driven roller such that the driven roller is rotatable.

3. The conveying apparatus according to claim 1, wherein each of the first engaging portion and the second engaging portion comprises an opening that exposes a portion of a surface of the rotation shaft with which said each of the first engaging portion and the second engaging portion is engaged, and wherein the opening of the first engaging portion and the opening of the second engaging portion are not oriented in the opposed direction.

4. The conveying apparatus according to claim 1, wherein the conveyance path is curved, wherein the first guide is located on an inner side of a curved portion of the conveyance path, and wherein the second guide is located on an outer side of the curved portion of the conveyance path.

5. The conveying apparatus according to claim 1, further comprising a plurality of conveying rollers as the conveying roller, wherein the plurality of conveying rollers are spaced apart from each other in the axial direction of the rotation shaft, wherein the first guide comprises a plurality of first engaging portions as the first engaging portion, and at least one of the plurality of first engaging portions is located between adjacent two of the plurality of conveying rollers, and wherein the second engaging portion is located on an outer side of the conveyance path in the axial direction of the rotation shaft.

6. The conveying apparatus according to claim 1, further comprising a detector configured to sense the sheet at a position located upstream of the nip position in the conveying direction, wherein the detector is supported by the first guide.

7. The conveying apparatus according to claim 1, further comprising:

a sheet-supply tray accommodating the sheet; and a sheet-supply roller configured to supply the sheet from the sheet-supply tray toward the conveyance path.

8. The conveying apparatus according to claim 7, further comprising a third guide comprising a third guide surface configured to guide the sheet supplied by the sheet-supply roller, toward the first guide and the second guide, wherein the third guide surface is an inclined surface intersecting a horizontal plane, and wherein an imaginary line included in the third guide surface extends through a position located between the first guide surface and the second guide surface in the opposed direction.

9. The conveying apparatus according to claim 8, wherein an obtuse angle at which the second guide surface of the second guide intersects the horizontal plane is equal to an obtuse angle at which the third guide surface of the third guide intersects the horizontal plane.

10. The conveying apparatus according to claim 8, wherein the first guide comprises a fourth guide surface located above an upper surface of the sheet-supply tray and extending toward the first guide surface.

11. The conveying apparatus according to claim 1, further comprising:

a first frame supporting the first guide; and a second frame supporting the second guide, wherein the first frame and the second frame are coupled to the supporter.

12. The conveying apparatus according to claim 7, further comprising a third frame supporting the sheet-supply roller such that the sheet-supply roller is rotatable, wherein the third frame is coupled to the supporter.

13. The conveying apparatus according to claim 12, further comprising:

a first frame supporting the first guide; and a second frame supporting the second guide, wherein the first frame and the second frame are coupled to the supporter.

14. The conveying apparatus according to claim 1, wherein the second guide comprises:

a roller supporter supporting the driven roller such that the driven roller is movable in the opposed direction; and an urging member configured to urge the driven roller toward the conveying roller.

15. A conveying apparatus, comprising:

a rotation shaft configured to be driven to rotate;

a conveying roller secured to the rotation shaft;

a driven roller opposed to the conveying roller and configured to cooperate with the conveying roller to nip a sheet at a nip position to convey the sheet;

a bearing supporting the rotation shaft such that the rotation shaft is rotatable;

a supporter on which the bearing is mounted; and a first guide and a second guide defining a conveyance path that guides the sheet from an upstream side of the nip position in a conveying direction toward the nip position, the first guide and the second guide being opposed to each other in an opposed direction orthogonal to each of the conveying direction and an axial direction of the rotation shaft, wherein the first guide is supported by the supporter and comprises a first recess having a U-shape in cross section and opening upward, wherein the second guide is supported by the supporter and comprises a second recess having a U-shape in cross section and opening upward, and wherein the rotation shaft is supported by the bearing in a state in which the rotation shaft is inserted in the first recess and the second recess.

* * * * *